United States Patent [19]

Yurko

[11] 4,397,777

[45] Aug. 9, 1983

[54] HEAVY DUTY LAUNDRY DETERGENT

[75] Inventor: Joseph A. Yurko, Bayonne, N.J.

[73] Assignee: Colgate Palmolive Company, New York, N.Y.

[21] Appl. No.: 170,987

[22] Filed: Jul. 18, 1980

Related U.S. Application Data

[60] Division of Ser. No. 766,655, Feb. 8, 1977, abandoned, which is a continuation of Ser. No. 505,626, Sep. 13, 1974, abandoned.

[51] Int. Cl.[3] ..... C11D 1/14; C11D 3/12; C11D 17/06

[52] U.S. Cl. ..... 252/536; 252/140; 252/153; 252/174.25; 252/179; 252/383; 252/385; 252/535; 252/554; 252/555

[58] Field of Search ..... 252/131, 140, 174.25, 252/179, 535, 536, 554, 555

[56] References Cited

U.S. PATENT DOCUMENTS

| | | | |
|---|---|---|---|
| 3,137,630 | 6/1964 | Hecker . | |
| 3,290,158 | 12/1966 | Treat | 252/385 X |
| 3,527,707 | 9/1970 | McAteer | 252/535 |
| 3,650,967 | 3/1972 | Johnson | 252/174.25 |
| 3,755,180 | 8/1973 | Austin | 252/99 |
| 3,769,222 | 10/1973 | Yurko et al. | 252/174.25 |
| 3,868,336 | 2/1975 | Mazzola | 252/527 |
| 3,875,082 | 4/1975 | Finck | 252/554 |
| 3,925,262 | 12/1975 | Laughlin | 252/526 |
| 3,932,316 | 1/1976 | Sagel | 252/532 |
| 3,950,276 | 4/1976 | Grand | 252/536 |
| 4,055,505 | 10/1977 | Gray | 252/102 |
| 4,274,975 | 6/1981 | Corkill | 252/140 |

FOREIGN PATENT DOCUMENTS

| | | | |
|---|---|---|---|
| 2422655 | 11/1974 | Fed. Rep. of Germany | 252/131 |
| 2519815 | 11/1975 | Fed. Rep. of Germany | 252/140 |
| 1429143 | 3/1976 | United Kingdom | 252/131 |
| 1473201 | 5/1977 | United Kingdom | 252/131 |
| 1504168 | 3/1978 | United Kingdom | 252/140 |

OTHER PUBLICATIONS

Linde Molecular Sieve Bulletin: Scavenging Water and Other Impurities with Molecular Sieves, pub. by Union Carbide, Dec. 1971, 4 pages.

*Primary Examiner*—Dennis L. Albrecht

[57] ABSTRACT

This invention relates to heavy duty laundry detergent compositions comprising a water-soluble mixture of paraffin sulfonate detergent, olefin sulfonate detergent and sodium silicate plus a water-insoluble molecular sieve or colloidal silica.

3 Claims, No Drawings

HEAVY DUTY LAUNDRY DETERGENT

This is a divisional of application Ser. No. 766,655, filed Feb. 8, 1977, now abandoned, which is in turn a continuation of application Ser. No. 505,626, filed Sept. 13, 1974, now abandoned.

This invention relates to heavy duty laundry detergents. More particularly, it relates to such detergents which need contain no phosphates or NTA builder salts and yet, which possess washing activities equivalent to commercial products containing substantial quantities of such materials. The invention also relates to a method of washing soiled fabrics, utilizing the invented compositions, and to a process for manufacturing the compositions.

It has been known for some time that inorganic phosphate builder salts are exceptionally effective in synthetic organic detergent compositions. However, in recent years an effort has been made to diminish the quantities of phosphates allowed to be employed in such compositions, due to possible eutrophication of inland bodies of water from discharges of the phosphates into such waters. Accordingly, efforts have been made to discover other builders which would be acceptable ecologically, while still being effective. At first it was suggested that nitrilotriacetates might be employed in place of phosphates but the use of such compounds has been suspended pending the outcome of tests to determine whether they are biologically safe. Silicates and carbonates have been employed but the latter have been objected to by the Surgeon General of the United States as hazardous, especially to small children who might ingest detergent powders containing them. While silicates have been effective in some formulas, they are not universally substitutable for phosphates to produce the same desirable washing actions. Therefore, specific formulas have been researched in an attempt to discover those which are commercially feasible and in which the particular combinations of detergent(s) and builder(s) employed give results equivalent to those formerly obtained with heavy duty phosphate-built compositions.

It has been found that the present formulations, containing a particular combination of known synthetic organic detergents, with particular types of builders, will wash various soiled fabrics as well as standard commercial heavy duty phosphate built products. The present formulations are effective for removing various soils from cotton, being found to be superior to the phosphate detergents in this respect. In accordance with the present invention there is provided a heavy duty laundry detergent composition comprising about 8 to 20% of a water soluble paraffin sulfonate detergent, about 4 to 12% of a water soluble olefin sulfonate detergent, about 12 to 30% of a water soluble sodium silicate of $Na_2O:SiO_2$ ratio in the range of 1:1.6 to 1:2.8, about 5 to 20% of a water insoluble molecular sieve or a silica of ultimate colloidal particle size or a mixture thereof, with the balance of the composition being moisture, detergent composition adjuvant(s), builder salts or filler salts or a mixture of any of these. In preferred aspects of the invention particular components in certain proportion ranges are employed for best results. The invention also relates to the use of such compositions as detergents for washing laundry in automatic washing machines and it includes an energy conserving method for the manufacture of such a powdered detergent product without the use of spray drying techniques.

The paraffin sulfonates of the present compositions include the primary paraffin sulfonates, such as the salts of sulfonic acid derivatives of higher primary paraffins, wherein the carbon atom content of the paraffin is usually from 14 or 16 to 22 carbon atoms, although it may be as broad as from 10 to 25 carbon atoms. The primary paraffin sulfonates are made by reacting long chain alpha-olefins and bisulfites, e.g., sodium bisulfite. Paraffin sulfonates having the sulfonate groups distributed along paraffin chain are also useful, such as the products made by reacting a long chain paraffin with sulfur dioxide and oxygen under ultraviolet light, followed by neutralization with NaOH or other suitable base (as in U.S. Pat. Nos. 2,503,280; 2,507,088; 3,260,741; 3,372,188; and German patent 735,096). The paraffin sulfonates, together with the olefin sulfonates, make the preferred anionic detergent components of the compositions of this invention. When employed alone, not together with the other composition components, they make the tackiest (and most objectionable, in this respect) detergent products but the present compositions are acceptably free flowing and non-tacky. The hydrocarbon substituent of the paraffin sulfonate preferably contains 14 to 18 or 20 carbon atoms and preferably averages about 18 carbon atoms. The paraffin sulfonate will normally be a monosulfonate but, if desired, may include di-, tri- or higher sulfonates. Typically, the paraffin sulfonate may include in admixture with the corresponding monosulfonate, for example, a disulfonate and such mixtures may contain up to 30% of such disulfonate.

Generally, such water soluble anionic organic surface active agents and detergents and other such anionic compounds herein described are salts of alkali metal cations, such as potassium, lithium (when suitable) and especially, sodium, although salts of ammonium cations and substituted ammonium cations derived from lower (2 to 4 carbon atom) alkanolamines, e.g., triethanolamine, tripropanolamine and diethanol monopropanolamine, and from lower (1 to 4 carbon atom) alkylamines, e.g., methylamine, sec-butylamine, dimethylamine, tripropylamine and triisopropylamine, may be utilized, too.

The olefin sulfonate salts are water soluble synthetic organic detergents which generally contain long chain alkenyl sulfonate and long chain hydroxy alkane sulfonate. The latter compounds have the hydroxyl on a carbon atom which is not directly attached to the carbon atom bearing the sulfonic acid group. More usually the olefin sulfonate detergent comprises a mixture of these two types of compounds (although either can be present alone), often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580; and British Pat. No. 1,139,158, and in the article by Baumann et al. in Fette-Seifen-Anstrichmittel, Vol. 72, No. 4, pages 247-253 (1970). All the above-mentioned disclosures are incorporated herein by reference. The number of carbon atoms in the olefin sulfonates is usually within the range of 10 to 25, more commonly 14 or 16 to 22, e.g., a mixture of principally $C_{14}$, $C_{16}$ and $C_{18}$, having an average of about 16 carbon atoms.

Although there is usually no necessity for employing any other anionic detergent than the mentioned paraffin and olefin sulfonates, such other anionic detergents may be utilized in addition to those mentioned, in total quantities up to the total of the paraffin sulfonate and olefin sulfonate detergents, preferably being less than half that total (including soaps).

Among the other anionic detergents that are useful may be mentioned the higher alkyl benzene sulfonate salts wherein the alkyl group is of 10 to 20 carbon atoms, preferably 10 to 16 carbon atoms. The alkyl group is preferably a straight chain alkyl radical of about 11 to 13 or 14 carbon atoms and preferably the alkyl benzene sulfonate has a high content of 3-(or higher) phenyl isomers and a correspondingly low content (well below 50%) of 2-(or lower) phenyl isomers; in other words, in such compounds the benzene ring is preferably attached in large part at the 3 or higher, e.g., 4, 5, 6 or 7 position of the alkyl group and the content of isomers in which the benzene ring is attached at the 1 or 2 position is correspondingly low. Typical alkyl sulfonate surface active agents of this type are described in U.S. Pat. No. 3,320,174.

Other anionic surface active agents (surfactants) that are useful are water soluble salts of, for instance, such higher fatty carboxylic acids as lauric, myristic, stearic, oleic, elaidic, isostearic, palmitic, undecylenic, tridecylenic, pentadecylenic, 2-lower alkyl higher alkanoic (such as 2-methyltridecanoic, 2-methyl pentadecanoic and 2-methyl heptadecanoic) and other saturated or unsaturated fatty acids of 10 to 20 carbon atoms. Soaps of dicarboxylic acids may also be used, such as soaps of dimerized linoleic acid. Soaps of such other higher molecular weight acids as rosin and tall oil acids, e.g., abietic acid, may also be employed. Additional anionic surface active agents are sulfates of higher alcohols, such as sodium lauryl sulfate, sodium tallow alcohol sulfate, sulfated oils, sulfates of mono- or diglycerides of higher fatty acids, e.g., stearic monoglyceride monosulfate; higher alkyl poly(lower alkenoxy) ether sulfates, i.e., the sulfates of the condensation products of a lower (2 to 4 carbon atoms) alkylene oxide, e.g., ethylene oxide, and a higher aliphatic alcohol, e.g., lauryl alcohol, wherein the molar proportion of alkylene oxide to alcohol is from 1:1 to 5:1, lauryl or other higher alkyl glyceryl ether sulfonates; and aromatic poly(lower alkenoxy) ether sulfates, such as the sulfates of the condensation products of ethylene oxide and nonyl phenol (usually having 1 to 20 oxyethylene groups per molecule, preferably 2–12). The ether sulfate may also be one having a lower alkoxy (of 1 to 4 carbon atoms, e.g., methoxy) substituent on a carbon close to that carrying the sulfate group, such as a monomethyl ether monosulfate of a long chain vicinal glycol, e.g., a mixture of vicinal alkanediols of 16 or 17 to 18 or 20 carbon atoms in a straight chain.

Other anionic detergents which may be employed include the higher acyl sarcosinates, e.g., sodium lauroyl sarcosinate; the acyl esters, e.g., oleic acid ester, of isethionates; and acyl N-methyl taurides, e.g., potassium N-methyl lauroyl- or oleyl tauride. Another type of anionic surfactant is a higher alkyl phenol sulfonate, for example, a higher alkyl phenol disulfonate. The disulfonate may be one in which the phenolic hydroxyl group is blocked, as by etherification or esterification; thus the H of the phenolic OH may be replaced by an alkyl, e.g., ethyl, or hydroxy polyalkoxyalkyl, and the resulting alcoholic OH may be esterified to form the sulfate.

While the aforementioned structural types of organic carboxylates, sulfates and sulfonates are generally preferred types of anionic surfactants, the corresponding organic phosphates and phosphonates are also useful.

In addition to the anionic synthetic organic detergent, nonionic and amphoteric surface active agents may also be present. In suitable cases cationic detergents or conditioning agents may also be employed but these are usually avoided due to possible interaction with the anionic compounds if they are not encapsulated or otherwise insulated from them. The nonionic detergents are usually inherently unctuous pasty or tacky solids at room temperature and normally will have melting points below about 40° C., although those which are normally solids at such and higher temperatures may also be useful. Typical nonionic detergents are poly-(lower alkenoxy) derivatives that are usually prepared by the condensation of a lower (2 to 4 carbon atom) alkylene oxide, e.g., ethylene oxide, propylene oxide, with compounds having hydrophobic hydrocarbon chains and containing one or more active hydrogen atoms, such as higher alkyl phenols, higher fatty alcohols, higher fatty acids, higher fatty mercaptans, higher fatty amides and polyols, e.g., fatty alcohols having 8 to 20 carbon atoms, typically 10 to 18 carbon atoms in an alkyl chain and alkoxylated with an average of about 3 to 20, typically 5 to 15 alkylene oxide units. Commercially available nonionic surfactants falling into this category are Neodol 45-11, which is an ethoxylation product (having an average of 11 ethylene oxide units) of a 14 to 15 carbon chain fatty alcohol (Shell Chemical Company); Neodol 25-7, a 12 to 15 carbon chain fatty alcohol ethoxylated with an average of 7 ethylene oxide units; Alfonic 1618-65, a 16 to 18 carbon alkanol ethoxylated with an average of 10 to 11 ethylene oxide units (Continental Oil Company); and Pluronic B-26, a 12 to 13 carbon alcohol etherified with ethylene oxide and propylene oxide (BASF Chemical Company).

Amphoteric organic surfactants are generally higher fatty carboxylates, phosphates, sulfates or sulfonates which contain a cationic substituent such as an amino group, which may be quaternized, e.g., with a lower alkyl group, or chain extended at the amino group by condensation with a lower alkylene oxide, e.g., ethylene oxide. In some instances the amino group may be a member of a heterocyclic ring. Representative commercial water soluble amphoteric organic surfactants include Deriphat 151, which is sodium N-coco betaamine propionate (General Mills, Inc.) and Miranol C2M (anhydrous acid) which is the anhydrous form of the heterocyclic diamino-dicarboxylate, sold by Miranol Chemical Co.

The molecular sieves most satisfactorily utilized in the practice of the invention are water insoluble crystalline aluminosilicate zeolites of natural or synthetic origin which are characterized by having a network of similarly or substantially uniformly sized pores in the range of about 3 to 10 Angstroms, which size is uniquely determined by the unit structure of the zeolite crystal (usually by the crystal form). Of course, zeolite molecular sieves containing two or more such networks of different sized pores can also be employed and mixtures of zeolites are useful, too.

The molecular sieve zeolite employed should also be a univalent cation exchanging zeolite, i.e., it should be an aluminosilicate of a univalent cation such as sodium, potassium, lithium (in suitable cases) or other alkali metal, ammonium or hydrogen. Preferably, such univalent cation is an alkali metal cation, especially sodium or potassium.

Preferred crystalline types of zeolites utilized as molecular sieves in the invention are zeolites of the following crystal structure: A, X, Y, L, mordenite, chabazite and erionite and other molecular sieve zeolites disclosed in Table 9.6 of the text, *Zeolite Molecular Sieves,* by Donald W. Breck, published by John Wiley & Sons in 1974. Generally, preferred are the molecular sieve zeolites with $Al_2O_3$:$SiO_2$ molar ratios of 1:2 to 1:4. Mixtures of these and equivalent molecular sieve zeolites can also be used. There preferred crystalline structure types of zeolites are well known in the ion exchange art. Most preferably the molecular sieve zeolite used is a synthetic molecular sieve type A crystalline zeolite, which is more particularly described on page 133 of the aforementioned Breck reference. Best results are generally obtained using a Type 4A molecular sieve zeolite wherein the univalent cation of the zeolite is sodium and the pore size of the zeolite is about 4 Å (nominal). These especially preferred zeolite molecular sieves are described in U.S. Pat. No. 2,882,243 which refers to them as zeolite A.

Molecular sieve zeolites can be prepared in either a dehydrated, calcined form which contains up to about 3% of moisture, e.g., 1 to 3%, or in a hydrated, i.e., water loaded form, which contains additional adsorbed water in an amount up to about 36%, e.g., 4 to 30%, depending on the type of zeolite used. Preferably the dehydrated form of the molecular sieve is employed, usually containing about 2% of water, but the hydrate may be employed, too. The manufacture of such crystals is well known in the art and they may be obtained commercially from various manufacturers, including Henkel & Cie. and Union Carbide Corporation. In the preparation of zeolite A, preferred to above, the hydrated zeolite crystals that are formed in the crystallization medium (such as a hydrous amorphous sodium aluminosilicate gel) are dehydrated or calcined, according to the normal practice in preparing crystals for use as catalysts, e.g., cracking catalysts. The hydrated form of zeolite, either completely hydrated or partially hydrated, can be recovered by filtering off the crystals from the crystallization medium and drying them in air at ambient temperature, without calcining, so that the water content is in the range of about 4 to 30%, e.g., 20 to 28.5%. It appears that the drier zeolites improve flowability of the detergent to a greater extent that the zeolites that contain more water, possibly because more pores thereof are "open".

The crystalline molecular sieve zeolites used are usually also substantially free of adsorbed gases, such as carbon dioxide, since such gas-containing zeolites may produce undesirable foaming on contact with water. Preferably, the molecular sieve zeolite should be in finely divided condition, such as crystals having mean particle diameters in the range of about 0.5 to about 12 microns, preferably 5 to 9 microns and especially about 5.9 to 8.3 microns. The sieves of 5.9 to 6.4 microns are generally better detergent builders, in addition to having good anti-caking and flow promoting properties but 8.3 micron diameter particles are sometimes preferred.

The silicas which may be employed in place of or in supplement of the molecular sieves (although the molecular sieves are much preferred) are of the pyrogenic or fumed type, usually having a particle size in the 0.1 to 10 micron range, preferably of 0.1 to 2 microns. Such products, referred to as colloidal silicas, are available under the tradenames Cab-O-Sil, such as Cab-O-Sil CH-5, made by Cabot Corporation or Cab-O-sil M-5, made by the same company; and Zeosyl 100, made by Huber Chemical Co., Inc. It is usually highly preferable to employ the molecular sieve alone, with no pyrogenic or fumed silica present but in many instances it will be possible to substitute up to half the normal content of molecular sieve with the fumed silica (using equal parts) and in some cases, all of it may be replaced but the products made are not usually as good as those based on the molecular sieve zeolite alone.

In addition of the mentioned constituents of the present compositions it is important to have present, as a suitable builder salt, a water soluble sodium silicate. Such builder should have an $Na_2O$:$SiO_2$ ratio in the range of 1:1.6 to 1:2.8, preferably 1:2 to 1:2.6 and most preferably about 1:2.5. Such a silicate is available from the Huber Chemical Co., Inc. With an $Na_2O$:$SiO_2$ ratio of 1:2.5, it is sold as a polysilicate under the identification, Huber CH-171-12-2. Other builder salts may be employed together with the sodium silicate and in some instances, a comparatively small quantity, up to 30% of the total alkali metal silicate content, of potassium silicate of similar $Na_2O$:$SiO_2$ ratio may be used. Among supplementing builder salts that may be employed are included sodium bicarbonate, borax, sodium gluconate and sodium citrate. In some instances, where it may not be objectionable to utilize the phosphates, nitrogen-containing builder salts or carbonates, pentasodium tripolyphosphate, tetrapotassium pyrophosphate, tetrasodium pyrophosphate, trisodium nitrilotriacetate and sodium carbonate may be utilized, preferably in total proportion not exceeding that of the silicate present. However, it is generally preferable to avoid employing phosphates, nitrogen-containing compounds and carbonates. In fact, one of the outstanding achievements of the present invention is that without using such builder salts excellent washing properties are obtainable, comparable to those of commercial phosphate-containing products with similar synthetic organic detergent active ingredient contents.

The laundry detergent formulations which are prepared from the invented molecular sieve zeolite-organic surfactant-silicate compositions may also advantageously include small amounts, e.g., 0.05 to 8%, of additional conventional detergent adjuvants. The total amount of such minor adjuvants generally does not exceed 20% and preferably does not exceed 10% of the product. These adjuvants include inorganic pigments, e.g., ultramarine blue; organic pigments, e.g., Indanthrene Blue RS; and dyes, e.g., Color Index Direct Blue 1 and especially the fluorescent dyes known as optical brighteners. Such brighteners may be coumarin, triazolyl stilbene, stilbene cyanuric, acylamino stilbene or miscellaneous types, such as shown in U.S. Pat. Nos. 2,911,415 and 3,031,460. The concentration of brighteners is advantageously in the range of about 1/20% to 1%, e.g., 1/10% to ½%.

The minor adjuvants may also include an organic gum anti-redeposition agent, such as sodium carboxymethyl cellulose, polyvinyl alcohol, hydroxymethyl ethyl cellulose, polyvinyl pyrrolidone, polyacrylamide, hydroxypropyl ethyl cellulose or mixtures thereof. Preferably the anti-redeposition agent is sodium carboxymethyl cellulose.

Additional minor detergent adjuvants which may be included in the detergent formulation include perfumes; fungicides or preservatives such as polyhalosalicylanilides, for instance, tetrachlorosalicylanilide; sanitizers, such as trichlorocarbanilide; foam suppressors, such as N,N-dilauryl (or di-coco alcohol), amines; enzymes, such as the subtilisin protease solid as Alcalase; bleaching agents, such as N-bromo and N-chloro imido compounds, for example, di- and tri-chloro (or bromo) cyanuric acid and water soluble salts thereof; fabric softeners, such as 1,2 alkane diols of 15 to 18 carbon atoms; and flow improving agents, such as the clay product, Satintone.

Fillers, such as sodium sulfate and sodium chloride and other alkali metal sulfates and chlorides may also be employed and moisture is usually present, too.

The proportions of the various components of the present heavy duty laundry detergent compositions utilized to obtain the desirable excellent washing characteristics (and flowability of the product) are: 8 to 20% of water soluble paraffin sulfonate detergent; 4 to 12% of water soluble olefin sulfonate detergent; 12 to 30% of water soluble sodium silicate; and 5 to 20% of water insoluble molecular sieve or silica of ultimate colloidal particle size or a mixture thereof. The balance of the composition will be moisture, detergent composition adjuvant(s), builder salts, filler salts or mixtures of such materials, and impurities. The proportion of moisture present will normally be from 4 to 22% and that of filler salt will be 5 to 40%. The total of detergent composition adjuvant materials present will be no more than 20% and preferably no more than 10%, with proportions of each of the adjuvants being in the 0.05 to 8% range. For example, a water soluble gum anti-redeposition agent, such as sodium carboxymethyl cellulose, will usually be present in a proportion between 0.2 and 3%. Proportions given are for anhydrous materials, on an "as is" basis, with the proportion of moisture indicated including moisture added together with the mentioned materials, which sometimes are utilized in solution and other times have water of hydration present. Thus, the molecular sieve zeolite, which may contain about 21% moisture in the final product, may be present to the extent of about 26%, on a hydrated basis.

Preferred proportions of the various components are 9 to 15% of sodium paraffin sulfonate, 5 to 10% of sodium olefin sulfonate, 20 to 30% of sodium silicate, 8 to 15% of molecular sieve (preferably Type A of a particle size in the range of 5.9 to 8.3 microns and a nominal pore size of about 4 Angstroms), 20 to 35% of sodium sulfate, 0.3 to 1% of sodium carboxymethyl cellulose and 10 to 20% of moisture. The preferred compositions are essentially phosphate-free and generally it will be desirably to have the products free of phosphates or phosphate-containing materials, free of nitrogen-containing compounds, such as nitrilotriacetates, and free of alkali metal carbonates, such as sodium carbonate. Even if some of such materials are present the compositions should be essentially free of them, meaning that there would be less than 10% of each of such materials present, preferably less than 3% and more preferably less than 1%.

An important advantage of the present composition is the ease of manufacture thereof without the need for expenditures of large quantities of energy, as are normally utilized in the spray drying of detergent compositions. The various components of the present products may be employed in powdered form (in some cases some of the constituents may be used as slurries or solutions) and preparation may be by mechanical mixing and milling techniques, which utilize comparatively little energy, compared to heat drying. Thus, a free flowing heavy duty detergent composition of the type described can be made by blending together the silicate and the molecular sieve and/or silica powders, as in a conventional ribbon or Lodige mixer or in a size reducing machine such as micropulverizer, after which the normally tacky paraffin sulfonate detergent is admixed with the pre-mix while milling the combination, until the mixture is in powder form. Subsequently, the other components of the detergent composition are admixed with the three-component mixture to produce a free flowing powder. Such operations may be undertaken at temperatures from 0° to 90° C. but preferably are effected at room temperature, e.g., 15° to 30° C.

The particle sizes of the various components employed, if not previously described, will preferably be in the range of 6 to 200 mesh, U.S. Standard Sieve Series, and the particle size of the product will normally be from 12 to 160 mesh, with many of the more finely divided particles adhering to larger particles so as to alleviate any dusting problems. Times of mixing and milling are variable but normally milling will be effected between mill rolls set apart a distance of 0.03 to 0.3 mm. and milling will be effected for a time from 30 seconds to 5 minutes. Mixing times for individual additives will be from 10 seconds to 5 minutes and total mixing times, exclusive of the milling time, will be from 2 to 30 minutes.

After the order of addition recited with respect to the silicate, molecular sieve and/or silica powders, and paraffin sulfonate, the addition sequence is not considered to be important but it will normally be desirable to balance the additions of poorer flowing and freer flowing materials so as to maintain an effective non-lumpy form of composition in the mixer. To this end, it may be desirable to add only portions of particular components at a time so as to maintain "fluidity" of the mix.

The final product, the free flowing powder, may be packaged immediately upon the conclusion of mixing or after a suitable cooling period and is ready for use.

Washing laundry with the present composition is carried out in a manner like that normally practiced with commercial heavy laundry detergents. The wash water, which may have a hardness ranging from 3 to 300 p.p.m., as calcium carbonate, usually contains a mixture of calcium and magnesium hardnesses, with the proportion of magnesium being less than that of calcium. It may be heated or employed "cold", usually at room temperature or slightly above. Thus, water with a hardness content of 50 to 200 p.p.m., preferably 50 to 150 p.p.m., at a temperature of 10° to 90° C., more frequently 15° to 40° or 50° C., in a washing machine tub of 10 to 25 gallon capacity, normally about 15 to 20 gallons (about 55 to 75 liters), has the desired amount of detergent composition added to it, usually from 0.05 to 0.5%, preferably 0.1 to 0.2% and most preferably 0.15%, after which the solid items to be washed are agitated in the detergent composition solution-suspension for from 5 to 60 minutes, preferably from 5 to 45 minutes. After completion of the automatic washing and rinsing, the laundry is dried, preferably in an automatic tumble dryer. In tests made against commercial heavy duty laundry detergent compositions intended especially for cold water washing (which is better for colored wash since it is does not adversely affect dyes), when the zeolite molecular sieves are employed the washed laundry is whiter than that washed with the phosphate-containing commercial detergent. When tumble dried after washing no deposition problems are encountered despite the employment of insoluble detergent composition materials. Also, despite the inclusion of normally tacky detergent components the products are sufficiently free flowing so as to be acceptable for commercial detergent compositions.

Thus, a heavy duty laundry detergent composition has been produced which can be made by energy conserving means, using simple equipment and can be produced at low cost from usually available detergent components. The method of manufacture applicable reduces pollution because it is comparatively simple to prevent loss of any dust to the atmosphere from a mixer, whereas such losses from a spray dryer may be more difficult to counteract. The detergent may be used in the same manner as are ordinary spray dried detergents but the effluent from the washing machine is non-polluting. The desirable effects obtained are attributable to the described combination of paraffin and olefin sulfonate detergents with the silicate and insoluble builder material, among which insoluble materials the zeolite molecular sieves are highly preferred because they contribute significant building action to the product and thereby, together with the silicate, increase its cleaning power and help to make it competitive with or superior to commercial heavy duty detergents.

The following examples illustrate but do not limit the invention. Unless otherwise indicated, all parts are by weight and all temperatures are in °C.

EXAMPLE 1

| | % |
|---|---|
| Paraffin sulfonate $C_{15}$ (1) | 12.0 |
| Higher olefin sulfonate (2) | 6.0 |
| Polysilicate (3) | 25.0 |
| Zeolite molecular sieve 4A (4) | 10.0 |
| Sodium carboxymethyl cellulose | 0.5 |
| Optical brightener mixture (5) | 1.0 |
| Perfume | 0.5 |
| Sodium sulfate, anhydrous | 26.7 |
| Moisture | 15.0 |
| Other materials (6) | 3.3 |
| | 100.00 |

(1) Normally tacky sodium paraffin sulfonate wherein the n-alkyl substituent contains 14 to 20 carbon atoms, with an average of 15 carbon atoms (Hoechst Chemical Corp.)
(2) Sodium olefin sulfonate, produced by sulfonating an alpha-olefin of 15 to 20 carbon atoms with about 1 molecular proportion of highly diluted sulfur trioxide, neutralizing with excess sodium hydroxide and heating the alkaline mixture at a temperature above 150° C. to ring-open sultones in the mixture.
(3) $Na_2O:SiO_2$ = 1:2.5
(4) A Type A synthetic sodium molecular sieve zeolite containing 2% moisture (proportions of molecular sieve zeolites given in this and the following examples are on an anhydrous basis) having a mean particle diameter of 8.3 microns (Union Carbide Corp.).
(5) 0.93% Tinopal 5BM conc. and 0.07% Tinopal RBS.
(6) Unreacted oils, sodium chloride and sulfonation byproducts.

The polysilicate and zeolite are weighed out into a mixing vessel and are mixed together in about two minutes, after which the paraffin sulfonate is admixed with the pre-mix as it is milled on a three roll mill with a 0.2 mm. setting between rolls. Milling is continued for seven minutes, until the paraffin sulfonate is worked into the other components and the mixture is powdery. Then the olefin sulfonate is added to the mixture and the mix is tumbled for two minutes, following which a mixture of the carboxymethyl cellulose (CMC) and optical brighteners is added and tumbled is continued for an additional two minutes. The sodium sulfate is then admixed with the tumbling mixture and mixing is continued for two minutes, after which perfume is added by spraying onto the surface of the tumbling mass and mixing is continued for an additional five minutes. Part of the water is added with the paraffin sulfonate and olefin sulfonate, part is present with the zeolite and any additional quantity needed is added at the end of the process, preferably before addition of the perfume.

The product obtained is a free flowing powder, all of which passes through a 12 mesh sieve and only a small portion of which passes through a 140 mesh sieve, with virtually none passing through a 200 mesh sieve (it appears that the very finely divided molecular sieve particles adhere to the other detergent composition particles or agglomorate so that the product is not dusty).

The heavy duty detergent made is tested in practical laundry tests and laboratory experiments, wherein it is compared to a commerically acceptable cold water heavy duty laundry detergent. The control detergent contains 9% of sodium linear tridecyl benzene sulfonate, 4% of ethoxylated alcohol (Neodol 45-11), 33.6% of pentasodium tripolyphosphate, 7% of sodium silicate ($Na_2O:SiO_2$=1:2.4), 34.8% sodium sulfate, 0.5% of sodium carboxymethyl cellulose, about 1% of optical brighteners and about 10% of moisture.

In comparative washings for 30 minutes at 32° C. in a mixed calcium, magnesium hard water (3:2 calcium:-magnesium ratio) at 110 parts per million, as calcium carbonate, at a detergent concentration of 0.15%, it is found that on test fabric cotton the present compositions are very significantly superior to the commercial product in removing mixed solids. They are essentially comparable in washing of test fabric nylon, Colgate-Palmolive Company Research and Development Department clay treated cotton, similarly clay treated Dacron:cott permanent press materials and test fabric (EMPA). As a result of a complex comparison of brightness readings obtained in washings of a wide variety of substrates soiled with different mixed soils it is concluded that under the washing conditions recited the present detergent formula is noticeably superior to a comparable (in active ingredient content) formula based on pentasodium tripolyphosphate.

In a modification of the above formula the paraffin sulfonate employed is one averaging 17 carbon atoms and the olefin sulfonate is of 14 to 22 carbon atoms, averaging about 18 carbon atoms. The composition produced with such changes is essentially of the same properties as that previously described. Also, when the polysilicate is replaced with one of an $Na_2O:SiO_2$ ratio of 1:2.35 the product produced is also competitive with commercial cold water heavy duty laundry detergents. Similarly, when the zeolite molecular sieve 4 A is replaced by Type X or Type Y molecular sieves, also of about the same particle sizes, similar building effects are obtained and the products are satisfactory commercial heavy duty laundry detergents, as they are with 6.2 micron molecular sieves. When half of the sodium sulfate content is replaced by pentasodium tripolyphosphate an improved product is obtained. In such a product it is sometimes desirable to replace one-quarter each of the paraffin sulfonate and higher olefin sulfonate with sodium tridecyl benzene sulfonate.

When the moisture content of the product is varied from 6 to 20%, product washing properties are unchanged but at the higher moisture contents flowability is somewhat less.

Other changes made in proportions and components of the composition of the above example, so long as they are within the scope of the previous description, also result in satisfactory laundry detergents. While it is undesirable to utilize phosphorus containing and nitrogen-containing builder salts and other component and while it is usually undesirable to employ alkali metal carbonates in these compositions, when they are utilized they do contribute their known building effects.

EXAMPLE 2

| | |
|---|---|
| Paraffin sulfonate $C_{15}$ (1) | 18.2 |
| Higher olefin sulfonate (2) | 9.1 |
| Polysilicate (3) | 18.2 |
| Silica, finely divided (7) | 9.1 |
| Sodium carboxymethyl cellulose (DuPont) | 1.5 |
| Optical brightener mixture (5) | 0.9 |
| Perfume | 0.5 |
| Sodium sulfate, anhydrous (FMC Corporation) | 34.3 |
| Moisture | 7.0 |
| Other materials (6) | 1.2 |
| | 100.0 |

(7) Zeosyl 100 (Huber Chemical Corp.)

In the above formula it is noted that the zeolite molecular sieve is replaced with finely divided silica (usually under 100 microns in diameter) and to compensate for this the proportion of synthetic anionic organic detergent is increased. The product resulting, which is manufactured by the method described in Example 1, when tested by the method described therein, is found to be essentially as effective a detergent as the commercial product with which it is compared. When the finely divided silica of the formula of Example 2 is replaced with the zeolite molecular sieve 4 A of Example 1 a further improvement in detergency results due to the better building action of the zeolite sieve, compared to the silica. However, the silica does improve flowability to almost the extent exhibited by the molecular sieve.

When the detergent composition is employed in hot water washing, at temperatures of 60° to 70° C., it is also found to be an acceptable laundry detergent of good detergency and other physical properties. This is also the case when the composition of Example 1 is so employed.

When, in the above formula, half the proportions of paraffin sulfonate and olefin sulfonate mentioned are replaced, respectively, by sodium linear dodecyl benzene sulfonate and Neodol 45-11 (as a melt added to the rest of the product in a tumbling drum shortly before addition of the perfume), effective heavy duty laundry detergents are also obtained. This is also the case when in such modified compositions half the nonionic detergent is replaced by the amphoteric detergent Miranol C2M.

When other changes are made in the formulation, as by the replacements of sodium carboxymethyl cellulose with polyvinyl alcohol, hydroxyethylmethyl cellulose and polyvinyl pyrrolidone, while anti-redeposition may not be as good, nevertheless the products are acceptable detergents. This is also the case with different optical brightener mixtures and when half of the sodium sulfate content is replaced by sodium chloride.

EXAMPLE 3

The formulas of Examples 1 and 2 are mixed together in equal proportions and in 2:1 and 1:2 proportions. The products so made are satisfactory detergents and all are comparable to the commercial detergent control previously described or superior to it in detergency.

EXAMPLE 4

The formulas of Examples 1 and 2 are spray dried from a 50% solids aqueous crutcher mix, which is mixed at a temperature of 80° C. and is sprayed into drying air at a temperature of 200° C. in a countercurrent spray tower at a pressure of about 100 kg./sq. cm. The particulate product is of spherical shape, of particle sizes in the 10 to 100 mesh range and has a moisture content of 12%, with the other component proportions being increased correspondingly. This product is a useful heavy duty laundry detergent but requires more energy to manufacture and requires additional pollution controls not needed for the manufacturing equipment previously described to make the products of Examples 1 and 2.

The invention has been described with respect to working examples and illustrations thereof but is not to be limited to these because it is evident that one of skill in the art with access to the present specification will be able to employ substitutes and equivalents without departing from the spirit or scope of the invention.

What is claimed is:

1. A heavy duty particulate laundry detergent composition comprising in weight percentages, 12% paraffin sulfonate wherein the paraffin alkyl group is from 14 to 20 carbons with an average of 15 carbons, 6% higher olefin sulfonate produced by sulfonating an alpha-olefin of 15 to 20 carbons with about one equivalent of diluted sulfur trioxide, neutralizing with excess sodium hydroxide and heating the alkaline mixture above 150° C. to open the sultone rings in the mixture, 25% polysilicate of the formula $Na_2SiO_3$ wherein the ratio $Na_2O$ to $SiO_2$ is 1 to 2.5, 10% 4 A zeolite molecular sieve containing 2% moisture and having a mean particle diameter of 8.3 microns, 0.5% sodium carboxymethyl cellulose, 1% optical brightener, 0.5% perfume, 26.7% anhydrous sodium sulfate, 15% moisture and 3.3% other materials associated with paraffin and olefin sulfonates.

2. A composition according to claim 1 comprising milled agglomerate particles.

3. A composition according to claim 2 comprising particles of a size from 12 mesh to 200 mesh.

* * * * *